United States Patent [19]

Stupin

[11] Patent Number: 4,756,730

[45] Date of Patent: Jul. 12, 1988

[54] CRYOGENIC RECOVERY OF HIGH PURITY HYDROGEN

[75] Inventor: Walter J. Stupin, Whittier, Calif.

[73] Assignee: Santa Fe Braun Inc., Alhambra, Calif.

[21] Appl. No.: 894,659

[22] Filed: Aug. 8, 1986

[51] Int. Cl.[4] ..... F25J 3/06

[52] U.S. Cl. ..... 62/23; 62/17

[58] Field of Search ..... 62/17, 18, 23, 24, 30, 62/32, 36, 42

[56] References Cited

U.S. PATENT DOCUMENTS

| | | | |
|---|---|---|---|
| 2,603,310 | 7/1952 | Gilmore | 62/17 |
| 3,359,744 | 12/1967 | Bolez et al. | 62/23 |
| 3,626,705 | 12/1971 | Knapp et al. | 62/23 |
| 3,628,340 | 12/1971 | Meisler et al. | 62/23 X |
| 3,691,779 | 9/1972 | Meisler et al. | 62/23 |
| 3,796,059 | 3/1974 | Banikiotes et al. | 62/23 |
| 4,242,875 | 1/1981 | Schaefer | 62/23 |
| 4,370,156 | 1/1983 | Goddin, Jr. et al. | 62/17 |
| 4,559,069 | 12/1985 | Becker | 62/23 X |

OTHER PUBLICATIONS

Eugene Guccione, "Cryogenic Washing Scrubs Hydrogen for Liquid-Fueled Rockets", *Chemical Engineering*, 70, May 13, 1963, pp. 150–152.

Wolfgang Forg, "Purification of Hydrogen by Means of Low Temperatures", Linde Report on Science and Technology, 1970.

*Primary Examiner*—Steven E. Warner

*Attorney, Agent, or Firm*—Lyon & Lyon

[57] ABSTRACT

A process for the cryogenic purification of industrial by-product hydrogen streams to recover a high yield of a high purity hydrogen product is disclosed in which two or more of such by-product streams, one containing detrimental amounts of non-readily condensible impurities having boiling points below that of methane, e.g., nitrogen, helium and the like, the other containing by-product hydrogen gas streams which are substantially free of non-readily condensible impurities. These two feed streams are then separately passed through successive cooling and separation stages. At each separation stage, a liquid bottom fraction containing readily condensible hydrocarbons is separated from the overhead of each of the two feed streams. Successive separations are carried out until the overhead from the stream which is substantially free of non-readily condensible impurities (but which contains a significant amount of readily condensible impurities, including methane) attains the desired degree of purity. At this point, the bottom fraction of this stream is predominantly liquid methane, and this bottom fraction is used to scrub a preponderance of nitrogen and like impurities from the overheads of the stream containing significant amounts of these non-readily condensible impurities.

6 Claims, 1 Drawing Sheet

CRYOGENIC RECOVERY OF HIGH PURITY HYDROGEN

BACKGROUND OF THE INVENTION

1. Field of the Invention

This invention relates to cryogenic purification of industrial by-product hydrogen streams to recover a high purity hydrogen product. More particularly, this invention relates to a novel cryogenic purification process which provides increased recovery of purified hydrogen from by-product hydrogen streams, such as those produced in oil refineries and petrochemical plants. The hydrogen thus recovered is sufficiently pure to permit its use in hydrocracking and hydrotreating petroleum feedstocks.

2. Description of the Prior Art

Many methods are known in the art for purifying by-product hydrogen produced in processes carried out at oil refineries, petrochemical plants and like installations, cryogenic methods being perhaps most commonly used. Such prior art cryogenic methods have conventionally involved first combining and compressing some or all of the various hydrogen-containing by-product streams generated during hydrocarbon processing to give a combined feed stream. This combined feed stream is then subjected to a series of heat exchange separations. These separations generally cool the stream no further than is necessary to cool it to a low enough temperature so that sufficient impurities, particularly nitrogen are condensed out to give a purified hydrogen product meeting target purity specifications.

The means known in the art for providing the refrigeration required to carry out such cryogenic purification methods include separate, external refrigeration systems; see, for example U.S. Pat. Nos. 3,626,705, issued Dec. 14, 1971 to Knapp et al and 3,628,340, issued Dec. 21, 1971 to Meisler et al ("Meisler et al I"), achieving a reduction in the pressure of the liquid condensate to cause it to flash at a lower temperature; see, for example, U.S. Pat. No. 3,359,744, issued Dec. 26, 1967 to Bolez et al, and the use of expanders; see, for example U.S. Pat. No. 3,796,059, issued Mar. 12, 1974 to Banikiotes et al. Such simple low temperature flash systems typically remove about 25 percent of the nitrogen contained in the by-product hydrogen stream. Greater nitrogen removal is not possible using such systems, however, since the lower temperatures required to condense additional nitrogen will also solidify the methane in the by-product stream.

Nitrogen and other non-readily condensible impurities, e.g., helium and the like, which have boiling points below that of readily-condensible impurities, e.g., hydrocarbons such as methane, also present in the by-product hydrogen stream are typically contained in by-product hydrogen streams from refinery processes such as fluid bed catalytic cracking of petroleum. If such by-product streams are to be used as the source of hydrogen in typical hydrocracking and hydrotreating processes, all or a preponderance of such non-readily condensible impurities must be removed.

Hydrocracking and hydrotreating are carried out under high pressures, consume large quantities of hydrogen and recycle still larger amounts of hydrogen through the reactor units. Reaction products and readily condensible impurities increase in concentration in the hydrogen recycle stream as the process continues to run, until their equilibrium solubilities in the oils exiting this high pressure loop lead to their removal with these oils. Reaction products and readily condensible impurities may also be removed by solvent scrubbing the recycled hydrogen — a step which can add significant costs to the process —or by purging a portion of this gas. However, nitrogen and other non-readily condensible impurities, which also increase in concentration in the hydrogen recycle stream as the process continues to run, are poorly soluble in the exiting oils, and thus are not removed with these oils.

The buildup of these non-readily condensible impurities in the loop reduces hydrogen partial pressure until the point is reached at which recycle gas must be purged to reduce the non-readily condensible impurity level. Typically, such a purge will contain about 5 to 10 mol percent nitrogen and at least about 75 mol percent hydrogen. In other words, to purge one mol of nitrogen approximately seven to fifteen times as much hydrogen must also be purged. Reduction of nitrogen and the other non-readily condensible impurities present by purging a portion of the hydrogen recycle stream, although necessary, is quite wasteful of both hydrogen and energy, since the purged gases, compressed under high pressure, are typically vented to a low pressure fuel system.

Hydrogen gas being fed to a hydrocracking or hydrotreating plant typically should contain not more than about 1.5 mole percent of non-readily condensible impurities if problems such as those mentioned above are to be avoided. Prior art cryogenic purification processes used to achieve this result generally have operated in one of two fashions.

In the first, all of the by-product hydrogen streams generated during hydrocarbon processing, those containing non-readily condensible impurities as well as those in which readily condensible impurities predominate, are first combined into one feed stream containing hydrogen, various hydrocarbons, and non-readily condensible impurities, including nitrogen; see, for example, U.S. Pat. No. 3,691,779, issued Sept. 19, 1972 to Meisler et al ("Meisler et al II)". If, however, all these by-product hydrogen streams are combined, expedients such as colder condensation temperatures, or a system which will adsorb the non-readily condensible impurities, or both must be employed to produce suitably purified hydrogen, with consequent increased energy consumption and capital costs. In the process of Meisler et al II, for example, an adsorption system is employed to remove the nitrogen remaining in the combined feed stream after this stream has passed through a series of cooling and condensation stages conducted at successively lower temperatures.

Another expedient which has been used in purifying such combined feed streams is to wash the feed stream with liquid methane*; see, for example, Eugene Guccione, "Cryogenic Washing Scrubs Hydrogen for Liquid-Fueled Rockets," *Chemical Engineering* 70, May 13, 1963, pp. 150–152; Wolfgang Forg, "Purification of Hydrogen by Means of Low Temperatures," Linde Report on Science and Technology, 1970. Since this requires a methane still, a pump and several heat exchangers to remove nitrogen and carbon monoxide from the circulating methane, it too is a relatively expensive system to operate.

The second type of prior art cryogenic processes for providing purified hydrogen gas feeds to hydrocracking or hydrotreating plants in essence involve giving up on recovering high purity hydrogen from the non-readily condensible impurity-containing by-product streams. Instead of treating all of the by-product hydrogen streams from a hydrocarbon processing unit, the readily condensible impurity-containing streams are purified while the non-readily condensible impurity-containing streams are discarded or merely used as fuel gas.

The Bolez et al U.S. Pat. No. 3,359,744 provides an example of such processes. It discloses injecting part of its purified hydrogen product into flashed impure liquid condensate obtained, as was the purified product, from by-product hydrogen streams containing readily condensible hydrocarbon impurities. This injection provides additional refrigeration to lower the partial pressure, and thus the temperature, of the hydrocarbon impurities present, and produces higher purity hydrogen. This result is accompanied, however, by significant losses of purified hydrogen product used to inject the flashed impure liquid condensate.

U.S. Pat. No. 4,242,875, issued Jan. 6, 1981 to Schaefer and of common assignment herewith, discloses a cryogenic purification process for purifying by-product hydrogen streams in which the streams containing substantially only hydrocarbons as impurities are kept separate from streams containing non-readily condensible impurities. In particular, two separate by-product gas streams containing hydrogen in recoverable amounts, one of which contains non-readily condensible impurities having a boiling point below that of methane, are passed through a successive series of cooling and separation stages. At each separation stage, a liquid bottom fraction containing hydrocarbons is separated from the overhead of the respective by-product feed gas stream until the overhead of the hydrogen product feed stream attains the desired purity. The hydrogen product overhead is passed back through the heat exchange means to provide refrigeration for the process, and the overhead is recovered as product. The overhead of the feed stream containing the non-readily condensible impurities is injected into the liquid condensate stream containing the combined liquid bottom fractions. This reduces the partial pressure of the condensates, thereby reducing their temperature. The condensate stream is also passed back through the first and second heat exchange means to provide increased refrigeration for the process, and the condensates are recovered as a fuel gas by-product; see column 3, lines 11–32 of the Schaefer patent. This process is not designed to maximize hydrogen recovery from all the by-product hydrogen streams it treats.

The need exists, therefore, for a cryogenic process that can be used to purify by-product hydrogen streams containing non-readily condensible impurities as well as those in which relatively condensible impurities predominate, without additional costly purification steps and without the sacrifice of an of the purified hydrogen produced.

It is an object of this invention to provide a cryogenic process for purifying industrial by-product gas streams containing recoverable amounts of hydrogen, such as those produced in oil refineries and petrochemical plants, which accomplishes increased recovery of high purity hydrogen.

It is also an object of this invention to provide a cryogenic process for purifying industrial by-product hydrogen gas streams, including those containing non-readily condensible impurities having boiling points below that of methane, which accomplishes increased recovery of high purity hydrogen.

Another object of this invention is to provide a cryogenic process for purifying industrial by-product hydrogen gas streams, including those containing non-readily condensible impurities having boiling points below that of methane, without the need for additional separation stages to remove such impurities and without the sacrifice of any of the high purity hydrogen produced.

A further object of this invention is to provide hydrogen which has been sufficiently purified to permit its use in hydrocracking and hydrotreating petroleum feedstocks.

These and other objects, as well as the nature, scope and utilization of the invention, will become readily apparent to those skilled in the art from the following description, the drawing, and the appended claims.

SUMMARY OF THE INVENTION

In practicing the process of this invention, two or more industrial by-product hydrogen gas streams are first segregated by type to give two feed streams for the process: one which combines all of the by-product hydrogen gas streams containing detrimental amounts of non-readily condensible impurities having boiling points below that of methane, e.g., nitrogen, helium and the like, the other combining all of the by-product hydrogen gas streams which are substantially free of non-readily condensible impurities. These two feed streams are then separately passed through successive cooling and separation stages. At each separation stage, a liquid bottom fraction containing readily condensible hydrocarbons is separated from the remaining overhead gas of each of the two feed streams. Successive separations are carried out until the overheads from the stream which is substantially free of non-readily condensible impurities (but which contains a significant amount of readily condensible impurities, including methane) attains the desired degree of purity. At this point, the bottom fraction of this stream is predominantly liquid methane, and this bottom fraction is used to scrub a preponderance of nitrogen and like impurities from the overheads of the stream containing significant amounts of these non-readily condensible impurities.

Since the two feed streams to this process remain separate instead of being combined into a single stream, abnormally lowered temperature or additional purification means, such as an adsorption system, are not needed to remove non-readily condensible impurities from the purer of the two streams before the hydrogen recovered from that stream can be used as a chemical reactant. Hence, the process of this invention requires less energy than hitherto employed cryogenic purification processes to produce a hydrogen product of the desired purity. In addition, when one or both of the feed streams to the process contain hydrocarbon impurities in recoverable amounts, these hydrocarbons too can be recovered in more concentrated forms than exist in the feed streams.

DETAILED DESCRIPTION OF THE INVENTION

Figure 1:
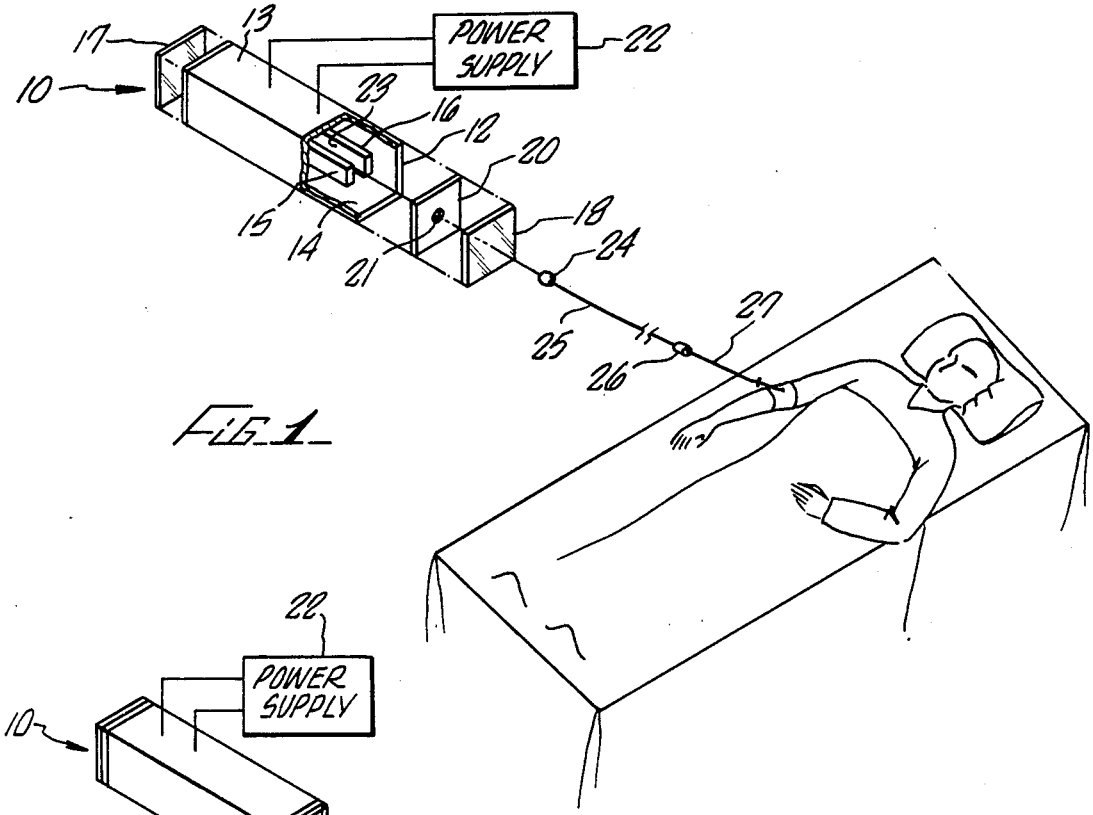
FIG. 1 is a schematic illustration of the process of this invention. It also illustrates, schematically, the novel arrangement of apparatus used to practice the process of this invention.

With reference to FIG. 1, typical by-product hydrogen streams carried in conduits 12, 14, 16, 18, 20, 22, 24 and 26 from various locations in an industrial hydrocarbon processing facility (not shown) are analyzed, segregated into two groups according to their readily condensible impurity and non-readily condensible impurity contents, and fed separately to a compressor plant 28 through a conduit 19, which combines all of the by-product hydrogen gas streams which are substantially free of non-readily condensible impurities having boiling points below that of methane, and which contain substantially only hydrocarbons as impurities, or through a conduit 27, which combines all of the by-product hydrogen gas streams containing significant amounts of non-readily condensible impurities having boiling points below that of methane.

At this point in the process the two gas streams entering the compressor plant 28 through the conduits 19 and 27 typically will undergo conventional acid gas removal steps (using means not shown). The separated acid gas can be withdrawn from the compressor plant 28 through a conduit 30.

The inlet temperatures and pressures employed when feeding the two gas streams to the compressor plant 28 will depend upon the sources of these streams. The choice of any particular condition or set of conditions is well within the knowledge of those having ordinary skill in the art.

The deacidified, compressed gas streams exiting the compressor plant 28 through the conduits 32 and 34 are fed, respectively, to driers 36 and 38. Here too, factors known to those skilled in the art will determine the extent of drying required and the conditions necessary to accomplish this.

From the driers 36 and 38, the two dried streams pass through conduits 40 and 42, respectively, to the chiller/fractionators 44 and 46, where the compressed gas streams pass through a series of heat exchange means (not shown) in which they are cooled by giving up heat to product streams flowing back through the heat exchangers. Separation drums (also not shown, except for the last drum in each series, indicated as the separation drums 54 and 62, respectively) are located between the several heat exchange means in each series. The consequent cooling of the feed streams causes hydrocarbon impurities contained therein to liquify. The resulting liquid condensates separate by gravity from the vapor phase in the separation drums. Hydrocarbons having boiling points above that of methane can be recovered from the series of separator drums used in processing each of the two feed streams by removal through the conduits 48 and 50 to give feedstocks suitable, for example, for coprocessing in an ethylene plant, or for other uses.

After passing through a conduit 52 to a final separation drum 54, the final predominantly liquid methane-containing bottom fraction of the original feed stream which was substantially free of non-readily condensible impurities having boiling points below that of methane and which contained substantially only hydrocarbons as impurities is fed through a conduit 56 to a methane absorber 58. Similarly, after passing through a conduit 60 to a final separation drum 62, the final overhead product of the original feed stream which combined all of the by-product hydrogen gas streams containing significant amounts of non-readily condensible impurities having boiling points below that of methane and which still has a substantial non-readily condensible impurities content is fed through a conduit 64 to the methane absorber 58 at a point below the inlet of the conduit 56. The methane absorber 58 contains trays or packing 59 to facilitate contact between the final predominantly liquid methane-containing bottom fraction fed through the conduit 56 and the final overhead product fed through the conduit 64 in the methane absorber 58. The liquid methane fed to the methane absorber 58 through the conduit 56 scrubs out a substantial fraction of the non-readily condensible impurities contained in the overhead product fed through the conduit 64 to the methane absorber 58, and these non-readily condensible impurities are carried away in the absorber bottoms removed from the methane absorber 58 through a conduit 66.

A stream of purified hydrogen emerges from the top of the methane absorber 58 through a conduit 68. Although not essential to the practice of the invention, this purified hydrogen stream can, if desired, be combined with the top stream of purified hydrogen exiting the separation drum 54 through a conduit 70 to form a combined purified hydrogen stream taken off by a conduit 72.

The absorber bottoms carried away from the methane absorber 58 through the conduit 66 can be combined with a bottom stream exiting the final separation drum 62 through the conduit 74 to form a combined bottoms stream taken off by a conduit 76. Both the purified hydrogen stream taken off through the conduit 72 and the bottoms streams taken off through the conduit 76 can be used to cool the feedstreams to the chiller/fractionators 44 and 46, or the chiller/fractionators 44 and 46 could be combined into a single unit by using multiple stream heat exchangers.

By practicing this process significant amounts of purified hydrogen can be obtained without the need for additional purification stages. Since the by-product hydrogen gas stream substantially free of non-readily condensible impurities provides the liquid methane used to scrub the non-readily condensible impurities from the less pure by-product hydrogen gas stream, no external methane still or absorption unit and accompanying apparatus is required, and substantial cost and energy savings are achieved. Also, because it is unnecessary to further cool either stream to condense out lower boiling compounds, energy and cost savings are achieved.

In a theoretical, calculated example, a typical pair of feedstreams, one of which combines all of the by-product hydrogen gas streams from an industrial hydrocarbon treatment process which are substantially free of non-readily condensible impurities and which contain substantially only hydrocarbon impurities (Stream A), the other of which combines the by-product hydrogen gas streams containing detrimental amounts of non-readily condensible impurities (Stream B), would have the following compositions:

| Component | Stream A Mole/Hr | Stream B Mole/Hr |
|---|---|---|
| $H_2$ | 2356.56 | 1841.06 |
| $N_2$ | 50.32 | 263.98 |
| CO | 0 | 62.22 |
| $CO_2$ | 9.35 | 135.90 |
| $H_2S$ | 45.73 | 75.62 |
| $C_1$ (methane) | 2612.82 | 2353.02 |

-continued

| Component | Stream A Mole/Hr | Stream B Mole/Hr |
|---|---|---|
| $C_2$ (ethane) | 844.45 | 1112.71 |
| $C_2^=$ (ethylene) | 0.63 | 686.78 |
| $C_3$ (propane) | 491.70 | 855.89 |
| $C_3^=$ (propylene) | 0.11 | 385.76 |
| i-$C_4$ (isobutane) | 101.70 | 65.58 |
| n-$C_4$ (n-butane) | 50.24 | 69.55 |
| $C_4^=$ (butene) | 3.47 | 100.36 |
| i-$C_5$ (iso-pentane) | 10.53 | 87.76 |
| n-$C_5$ (n-pentane) | 0.42 | 48.16 |
| $C_6^+$ (hexanes and heavier) | 27.76 | 45.36 |
| Total (dry) | 6605.79 | 8189.71 |

After proceeding through the compression, acid gas removal, drying, cooling and fractionation and separation steps described above in detail, the feedstream exiting the chiller/fractionator 44 through the conduit 52 (Stream A') and the feedstream exiting the chiller/-fractionator 46 through the conduit 60 (Stream B') would have the following compositions:

| Component | Stream A' Mole/Hr | Stream B' Mole/Hr |
|---|---|---|
| $H_2$ | 2111.8 | 1742.1 |
| $N_2$ | 45.4 | 172.9 |
| CO | 0.6 | 36.8 |
| $C_1$ | 1355.1 | 330.5 |
| $C_2$ | 16.7 | 0.1 |
| $C_2^=$ | 0.3 | 0.3 |
| Total | 3529.9 | 2282.7 |

After passing Stream A' through the separation drum 54, the compositions of the streams exiting this separation drum through conduit 70 (Stream A'') and the conduit 56 (Stream B'') would be as follows:

| Component | Stream A'' Mole/Hr | Stream B'' Mole/Hr |
|---|---|---|
| $H_2$ | 2063.1 | 48.7 |
| $N_2$ | 20.4 | 24.9 |
| CO | 0.2 | 0.4 |
| $C_1$ | 49.4 | 1305.8 |
| $C_2$ | | 16.7 |
| $C_2^=$ | | 0.3 |
| Total | 2133.1 | 1396.8 |

Stream B'', primarily liquid methane with small amounts of dissolved hydrogen and impurities, will be at a temperature of about −274° F. and a pressure of about 503 psia, while Stream A'' will be at about −274° F. and a pressure of about 504 psia.

The final output from the methane absorber 58— the stream of purified hydrogen exiting the top of the absorber through the conduit 68 (Stream C) and the absorber bottoms exiting the absorber through the conduit 66 (Stream D) — would have the following composition:

| Component | Stream C Mole/Hr | Stream D Mole/Hr |
|---|---|---|
| $H_2$ | 1726.4 | 49.1 |
| $N_2$ | 20.9 | 128.7 |
| CO | 0.2 | 23.1 |
| $C_1$ | 48.8 | 1298.0 |
| $C_2$ | | 16.7 |

-continued

| Component | Stream C Mole/Hr | Stream D Mole/Hr |
|---|---|---|
| $C_2^=$ | | 0.3 |
| Total | 1796.3 | 1515.9 |

The purified hydrogen stream exiting the top of the methane absorber 58 through the conduit 68 in combination with the top stream of purified hydrogen exiting the separation drum 54 through the conduit 70, i.e., the combined purified hydrogen stream taken off by the conduit 72 (Stream E), would have the following composition:

| Component | Stream E Mole/Hr |
|---|---|
| $H_2$ | 3789.5 |
| $N_2$ | 41.3 |
| CO | 0.4 |
| $C_1$ | 98.2 |
| Total | 3929.4 |

The combined purified product stream (Stream E) contains an acceptably low amount of nitrogen, and yet 90% of the total hydrogen available from both the pure and impure initial by-product feed streams is recovered. The remaining 10% of the hydrogen originally present is divided among the various bottom streams.

Industry standards generally require the use of hydrogen of 90% or greater purity for hydrocracking and hydrotreating processes; about 1.5% non-readily condensible impurities is also typically considered an upper limit for these impurities in such purified hydrogen feed streams. Both of these standards are met by the process of this invention.

The above discussion of this invention is directed primarily to preferred embodiments and practices thereof. Further modifications are also possible without departing from the inventive concept. Thus, simplification of the process by eliminating one or more intermediate separation drums is possible in either or both of the series of cooling and separation stages used to separately treat the two combined feed streams to the process, as is the use of more than two combined feed streams. Any feed streams containing hydrogen, with or without hydrocarbons in recoverable amounts, may be used as feeds to the process, and not only nitrogen but any number of non-readily condensible impurities having boiling points below that of methane may be contained in the feed stream having significant amounts of non-readily condensible impurities. Accordingly, it will be readily apparent to those skilled in the art that still further changes and modifications in the actual implementation of the concepts described herein can readily be made without departing from the spirit and scope of the invention as defined by the following claims.

I claim:

1. A process for the cryogenic purification of two or more industrial by-product gas streams containing impure hydrogen in recoverable amounts, at least one of the by-product gas streams being substantially free of non-readily condensible impurities having boiling points below that of methane and containing only hydrocarbons, including methane, as impurities, and at least one of the by-product gas streams containing significant amounts of non-readily condensible impurities having boiling points below that of methane, comprising:

separately passing the by-product gas streams substantially free of non-readily condensible impurities constituting a first feed stream, and the by-product gas streams containing significant amounts of non-readily condensible impurities constituting a second feed stream, through cooling and separation stages to separate, at each stage, a hydrogen containing gas stream overhead fraction from a condensed bottom fraction, the hydrogen containing gas stream overheads from said second feed stream also containing the non-readily condensible impurities, feeding the hydrogen containing gas stream overhead fraction of said second feed stream from the last of the separation stages to a methane absorber, feeding the first feed stream's bottom fraction from the last of the separation stages to the methane absorber, and recovering a purified overhead hydrogen gas stream from the methane absorber.

2. A process as recited in claim 1 wherein the first and second feed streams undergo compression, acid gas removal and drying before being separately passed through the series of cooling and separation stages.

3. A process as recited in claim 1 wherein the purified overhead gas stream from the methane absorber comprises greater than 90 mole percent hydrogen and not more than about 1.5 mole percent of non-readily condensible impurities having boiling points below that of methane.

4. A process as recited in claim 1 wherein hydrocarbon impurities having boiling points above that of methane contained in recoverable amounts in the first and second feed streams are recovered in concentrated form from the condensed bottoms fractions from the series of cooling and separation stages.

5. A process as recited in claim 1 in which the bottom fraction of said first feed stream from the last of the separation stages is fed to the methane absorber at a place higher than that at which the hydrogen gas stream overhead fraction of said second feed stream from the last separation stage is fed to the absorber.

6. A process as recited in claim 1 in which the absorber contains trays or packing to facilitate contact between the bottoms liquid of the said first feed stream from the last separation stage and the overhead of the second feed stream from the last separation stage.

* * * * *

UNITED STATES PATENT AND TRADEMARK OFFICE

CERTIFICATE OF CORRECTION

PATENT NO. : 4,756,730

DATED : July 12, 1988

INVENTOR(S) : Walter J. Stupin

Figure 2:
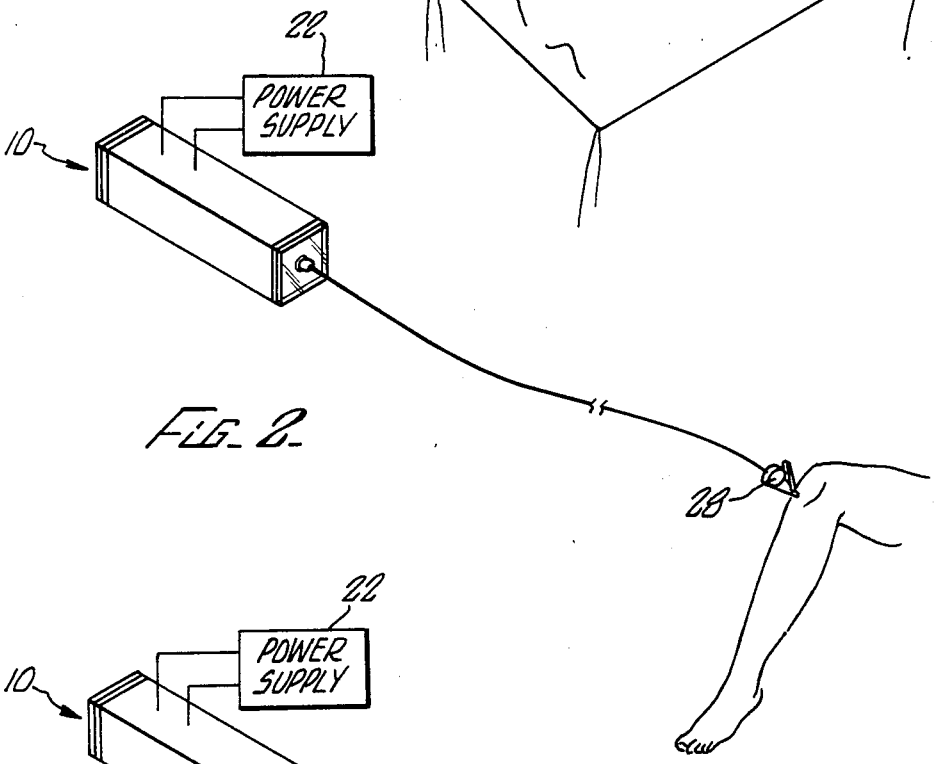
Figure 3:
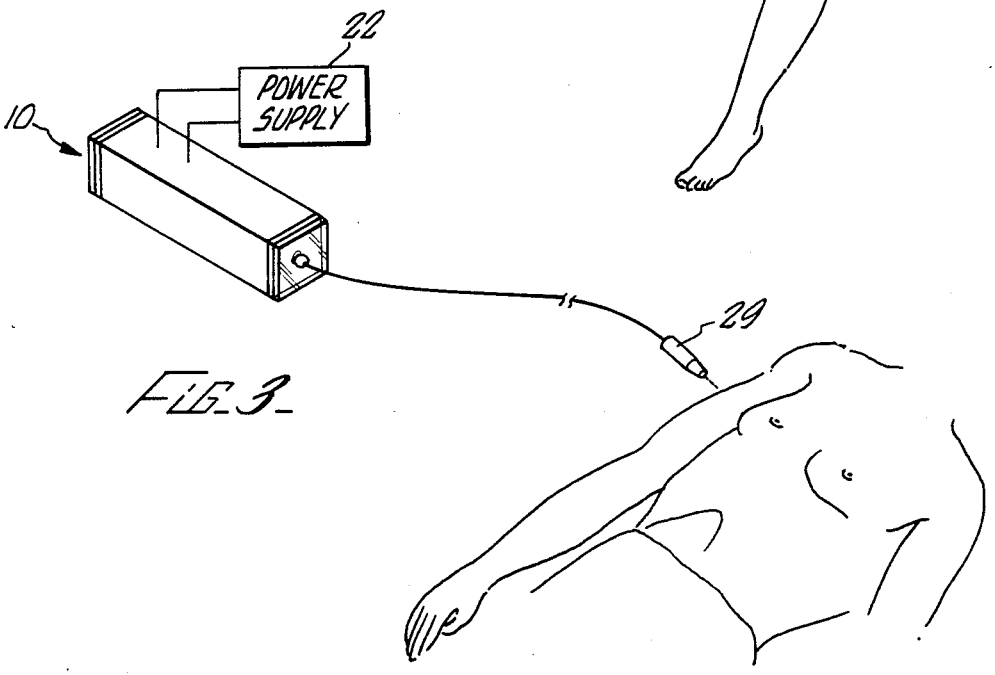
Figure 1:
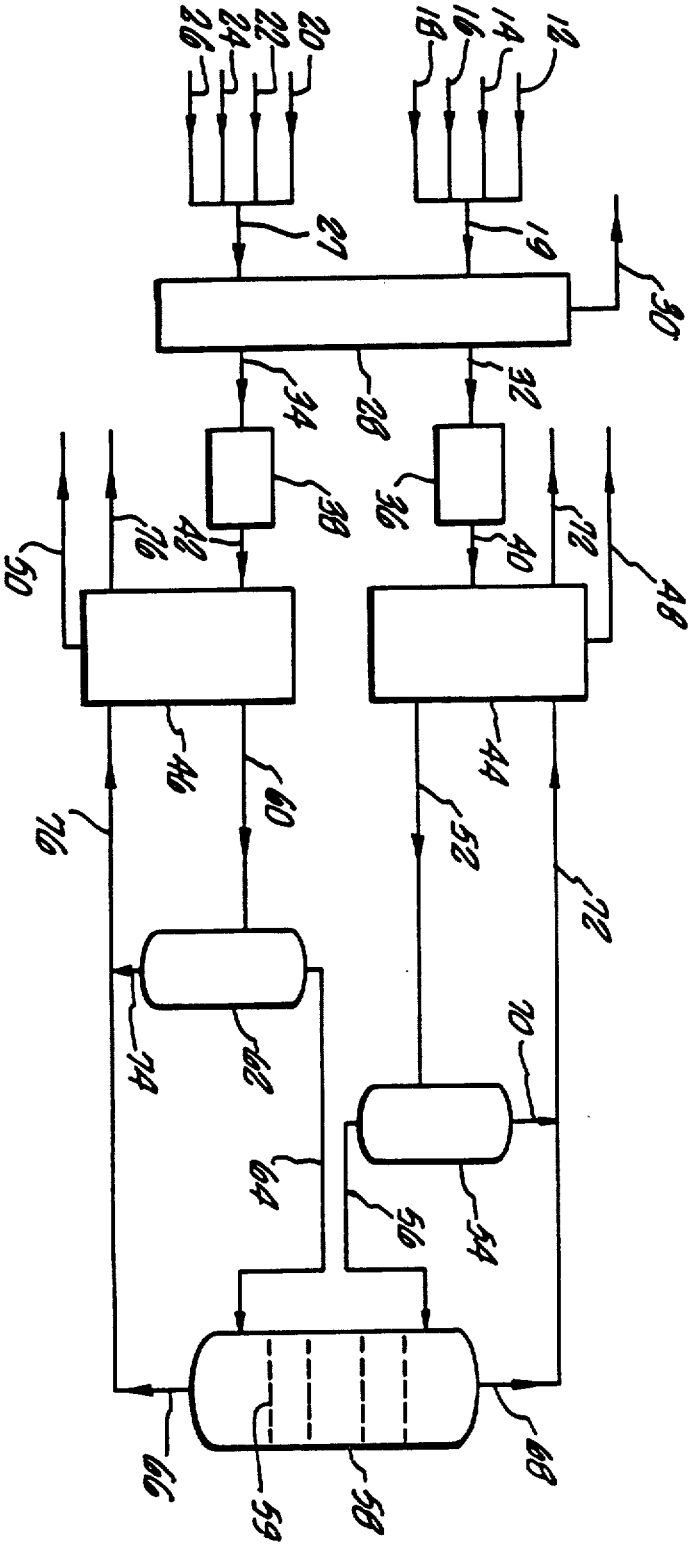

It is certified that error appears in the above-identified patent and that said Letters Patent is hereby corrected as shown below:

Figures 1-3 of the Drawings should be deleted to be replaced with Figure 1 as shown on the attached sheet.

Signed and Sealed this

Fourth Day of April, 1989

*Attest:*

DONALD J. QUIGG

*Attesting Officer*

*Commissioner of Patents and Trademarks*